United States Patent [19]

Lebreton

[11] Patent Number: 4,904,115

[45] Date of Patent: Feb. 27, 1990

[54] METHOD AND DEVICE FOR CONTROLLING THE TRAJECTORY OF A SHIELD-TYPE TUNNELLING MACHINE

[75] Inventor: Vincent Lebreton, Creil, France

[73] Assignee: Charbonnages de France, Rueil-Malmaison, France

[21] Appl. No.: 182,833

[22] Filed: Apr. 18, 1988

[30] Foreign Application Priority Data

Apr. 16, 1987 [FR] France ..... 87 05443

[51] Int. Cl.[4] ..... E21D 9/06

[52] U.S. Cl. ..... 405/143; 299/1; 405/141

[58] Field of Search ..... 405/143, 141, 138, 146; 299/1, 31, 33

[56] References Cited

U.S. PATENT DOCUMENTS 2,139,563 12/1938 Russell ..... 405/143
4,228,508 10/1980 Benthaus ..... 299/1 X
4,322,113 3/1982 Taylor et al. ..... 299/1
4,412,758 11/1983 Heitkamp et al. ..... 405/141 X
4,513,504 4/1985 Nussbaumer et al. ..... 299/1 X
4,648,659 3/1987 Masovich et al. ..... 299/1

FOREIGN PATENT DOCUMENTS 3231544 3/1984 Fed. Rep. of Germany .
2275637 1/1976 France .
2483007 11/1981 France .

*Primary Examiner*—Dennis L. Taylor
*Attorney, Agent, or Firm*—Browdy & Neimark

[57] ABSTRACT

Method of controlling the trajectory of a shield-type tunnelling machine equipped with displacement control hydraulic rams (3), characterized in that, these rams being divided into at least three groups of rams (6A, 6B, 6C), the theoretical instantaneous flowrates of fluid to be applied to each of these groups are continuously determined (40) from the curvature characteristics and the overall rate of advance set point trajectory and these groups (7-26-27-28) are supplied with instantaneous flowrates, the values of which correspond to the theoretical values.

13 Claims, 7 Drawing Sheets

METHOD AND DEVICE FOR CONTROLLING THE TRAJECTORY OF A SHIELD-TYPE TUNNELLING MACHINE

The invention concerns the directional control of a shield-type tunnelling machine for drilling tunnels and is more particularly directed to a method and a device for controlling the actuators (hydraulic rams) of a tunnelling machine of this kind.

As known, a tunnelling machine is generally cylinder-shaped with the diameter and the length often of the same order of magnitude (6 to 8 meters, for example). This cylinder comprises a cylindrical sleeve, a cutting wheel at the front and a ring of actuators at the rear which, pushing against tunnel lining members, propel the tunnelling machine.

The tunnel is generally lined with reinforced concrete lining members, but any other type of lining may be used.

The actuators may be of various types. However, on these machines they are in practice hydraulic rams which are characterised by their ability to generate the high thrust required to displace the tunnelling machine.

The magnitude of this thrust depends in particular on :

- the nature of the formation, either generally or locally,
- the curvatures adopted for driving the machine,
- the required rate of advance, and
- how the cutting wheel at the front is used (possible inclination and offset of the wheel, overcutting, rotation speed, etc).

At this time, methods of controlling the actuators of a tunnelling machine are essentially manual with the operator himself adjusting certain parameters individually, keeping them fixed for several minutes or even several tens of minutes, and reajusting them regarding the evolution of the characteristics of the advance obtained.

Practically these methods are classified into two types.

In a first type of method, essentially Japanese, the actuator rams distributed in a ring at the rear of the tunnelling machine (usually divided into angular groups or sectors) are all connected in parallel to the same hydraulic circuit comprising a plurality of hydraulic pumps with fixed flowrate (or variable flowrate to modify the overall rate o advance) equipped with respective drive motors. Non-return valves are provided on the output side of each pump to enable them to be shut off and isolated. The circuit further comprises a storage tank of fluid (oil) from which the pumps take up the fluid and into which the fluid is discharged when the pistons move.

The number of pumps used allows to vary the total flowrate of oil fed to the rams as a whole and therefore the rate of advance of the shield assembly (when the pumps have a fixed flowrate).

By cutting off the supply to a certain number of adjacent rams occupying an angular sector of appropriate amplitude, the distribution of the thrust forces on the shield is modified and therefore the direction of the machine is modified towards the side on which the rams have been disabled in this way.

If the feed pressure to the rams is denoted P, disabling a ram eliminates at this location a thrust force $P \times S$ where S represents the effective surface area of the ram subject to the pressure P.

To increase the flexibility of an "all or nothing" method of this kind it is known to provide a variable pressure limited in the hydraulic circuit on the input side of each group of actuators. The threshold of each limiter is adjusted manually according to the required change of trajectory: it allows a better modulation of the differential thrust to be applied. Thus, for example, in the case of actuators regularly distributed around a ring, divided into four groups, for example identical and each occupying an angular sector with an amplitude of 90°, the limiter of the group on the side to be turned towards is adjusted to a low threshold value (for example 80 bars, that is to say in the order of $\frac{3}{4}$ of the working pressure) ; the limiters associated with the adjacent groups are adjusted to a slightly higher value and the limiter of the diametrically opposite group is disabled (no limitation).

The adjustments (pressure limitation, actuators disabled) are chosen manually, according to a visual estimate of the direction of the machine.

The direction of the machine is estimated :

- either by noting the point of impact of a laser beam on a graduated target on which the position corresponding to the laser impact point for the theoretical position of the machine is marked, the difference between these two points giving the positional offset,
- or by measuring the elongation of two reference actuators placed on a horizontal line at the level of the axis of the machine.

In either case the control method consists in adjusting the advance parameters (choosing the actuators disabled and the settings of the pressure limiters) and then, after a certain excavation time (from a few minutes to some 15 minutes) verifying the change in position. If the result is insufficient, it is reinforced by disabling a further actuator and/or by adjusting the limiters ; if it is too much, one of the disabled actuators is re-enabled. However, certain machine configurations rule out re-enabling an actuator that has previously been disabled, which limits the possibilities for such action.

Thus the adjustment is performed each time it is necessary and is all the more difficult to achieve in that the thrust differential depends on several parameters :

- geometrical parameters (curvature radii . . . , ),
- the rate of advance,
- the geological formation,
- the mode of utilisation of the cutting wheel (overcutting, etc).

A method of this kind is inexpensive because a single and simple hydraulic circuit is used, but has several disadvantages, especially when used without pressure limiters:

(a) since the pressure changes during the excavation cycle (digging out the location for a lining ring) between the start of the cycle (when it is 80 bars, for example) and the end of the cycle (typically 120 bars, for example, with this type of machine), disabling an actuator amounts to eliminate at the beginning of the cycle a thrust corresponding to 80 bars and at the end of a cycle a thrust corresponding to 120 bars, so that the result of disabling an actuator is not the same at the beginning and at the end of the excavation cycle:

(b) disabling actuators results in a highly irregular load on the lining structure, which tends to disturb it;

(c) disabling an actuator causes the oil that would otherwise be directed to it to be directed to the other actuators, increasing their rate of advance and the pressure in them, which tends to reinforce the pressure increase phenomenon when an actuator is disabled during excavation. This phenomenon does not occur if the limiter of the sector concerned is a limiter discharging to the storage tank (three-way type), but does occur if it is a limiter with no discharge facility (two-way type with no discharge to the storage tank);

(d) the limiters are not effective unless the general pressure in the hydraulic circuit is higher than the value to which the limiters are set. Thus if the limiters are set too high they will not be operative at the beginning of the cycle, whereas if they are adjusted too low they can be operative immediately, but with a relative loss of thrust capacity. This can be avoided if the limiters used discharge to the storage tank and if the total hydraulic flowrate used is greater than the one necessary to obtain the limiters' pressure.

In methods of the second type the various groups of thrust rams are fed by hydraulic circuits that are separate at the level of the high-pressure hoses but are fed by pumping sets that are interdependent or controlled in an interdependent way.

In the same way as with the first solution, the starting up of a variable number of pumps serves to modulate the average rate of advance of the machine.

To avoid having too many pumps and drive motors each motor drives a multiple flowrate pump comprising a plurality of pistons, each piston being associated with a thrust group (as a general rule, as many pistons per pump as there are groups of rams, or any equivalent combination of pistons).

To deflect the trajectory of the shield, the pressure is set lower on the side to be turned towards and higher on the opposite side. For example, in a configuration with six groups each occupying a 60° angular sector and with a working pressure in the order of 100 to 200 bars, the limiting threshold could be 120 bars on the side to be turned towards, 150 bars on the opposite side and respectively 130 and 140 bars for the groups situated adjacent the 120 and 150 bars groups.

This method has the advantage as compared with the previous method of employing independent hydraulic circuits, adjustment of one group affecting only the rams of the group concerned.

In a similar way, control is based:

either on a laser target, or on visual measurement of the elongation of reference rams.

In either case, when the operator has adjusted the pressures he waits between a few and some 15 minutes to find out if his adjustment is correct, in order to improve it subsequently.

The adjustments are thus carried out each time it is necessary with no real continuous control, the accuracy of the means employed and the speed of interpretation by the operator being insufficient for continuous, precise control.

Whichever method is used, the use of thrust forces to adjust the elongation of the ram is unsuitable as this quantity depends on parameters badly mastered others than the geometry ; all the more so in that the operator is unable to act with sufficient speed and precision to adjust the thrust forces to be provided to obtain the correct elongations.

An object of the invention is to overcome the aforementioned disadvantages.

As known, in general, when using rams, the hydraulic pressure is related to the value of the force to be applied and generally speaking a hydraulic circuit is controlled by acting on this pressure. This phenomenon is all the more marked in that pressure is a quantity that the hydraulic engineer can control well in terms of its action and in terms of monitoring it by measurement. On the other hand, monitoring a flowrate is regarded as difficult, and often amounts to observe a difference in pressure which is also conditioned by the viscocity and the temperature of the hydraulic fluid, the values of which are extremely variable in circuits of this kind.

As a result, hydraulic thrust rams are conventionally controlled in terms of force, generally by reducing the pressure in certain rams in order to limit their elongation relative to the others. A pressure limiter supplies, to the circuit concerned, only the flowrate necessary for obtaining the required pressure, and diverts the residual flowrate to the storage tank of the hydraulic circuit.

This form of pressure control is therefore an INDIRECT way of controlling the flowrate whereas the pressure-flowrate function depends essentially on external parameters that are beyond control (see above).

Given the above remarks regarding thrusts, it is readily understandable why controlling a tunnelling machine by controlling the thrust pressures is difficult. We are led inevitably to the conclusion that, to control the elongation of the rams for controlling the machine, it is necessary to control the flowrate at which the hydraulic fluid is supplied, which goes against the normal practices of the skilled in the art.

The invention therefore proposes a method of controlling the trajectory of a shield-type tunnelling machine provided with displacement control hydraulic rams, characterised in that, the rams being divided into at least three groups, the theoretical instantaneous value of the fluid flowrate to be applied to each of these groups is continuously determined from the curvature characteristics of a set point trajectory and overall rate of advance, and the instantaneous flowrates supplied to these groups have values corresponding to the theoretical values.

An actual elongation is preferably measured at not less than three reference points offset angularly at the periphery of the tunnelling machine, the theoretical values of these elongations are computed as a function of the instantaneous curvature of the intended trajectory and the instantaneous overall rate of advance, and the flowrates actually supplied to said groups are corrected so as to reduce the differences between the actual and theoretical elongations at these reference points.

To give an example, a reference point is preferably associated with each group and is advantageously positioned on the bisector of the angular sector occupied by that group.

The invention also proposes a device for controlling the trajectory of a shield-type tunnelling machine comprising displacement control hydraulic rams disposed in a ring and divided into at least three groups, comprising a pumping set drawing up fluid from a storage tank to feed it to the rams, characterised in that there corresponds to each group of rams, with the possible exception of not more than one group, a hydraulic circuit comprising a variable flowrate pumping set, a computation unit being provided to determine continuously theoretical values of the flowrates to be supplied to each group of rams from the curvature characteristics of a set point trajectory, this unit being connected to each of the pumping sets so as to make them to deliver a flowrate corresponding to the theoretical values. Preferably a hydraulic circuit comprising a variable flowrate pumping set corresponds to each group without exception.

According to preferred features :

- the device further comprises at least one elongation sensor per group of rams connected to the computation unit which is adapted to compute theoretical values of elongation at the location of these sensors and to correct the flowrate supplied to each group according to the difference between the theoretical and actual elongation values ;
- each pumping set comprises a fixed capacity (multiple-flowrate, for example) pump driven by a variable speed motor controlled by a variable speed drive activated by the computation unit;
- each pumping set comprises a variable capacity (optionally multiple-flowrate) pump driven by a fixed speed motor and controlled according to the flowrate measured on the output side ;
- each pumping set comprises a fixed flowrate, advantageously multiple-flowrate pump delivering fluid via a proportional servo-valve for adjusting the flowrate according to the flowrate measured on the output side ; multiple flowrate pumps reduce losses at low useful flowrates ;
- solenoid valves for selecting the active pistons are provided at some at least of the outputs of a multiple-flowrate pump ; and
- a pressure limiting circuit is provided to counteract the pressure of the cutting face when excavation, using a pressurised tunnelling machine, is halted.

Thus the invention is preferably based on :

- the advantageous utilisation of high-PRECISION displacement sensors providing an accurate indication of the position of the machine and how this is continuously changing (high resolution is required for a control method of this kind, much higher than that of the sensors habitually used until now, which are generally just graduated rulers !) ;
- continuous control over the supply flowrate to the rams in order to ensure AT ALL TIMES the APPROPRIATE RATIO between the elongations of the various rams. The supply flowrate of the rams must be adjusted in a fine way and not only with fixed thresholds in order to obtain the correct ratio between elongations.

Moreover, to avoid loss of directional control under transient conditions on starting up and changing speed, it is desirable to have a system for adjusting the flowrate with known characteristics and that is controlled directly so that a flowrate very close to the required flowrate can be obtained before its consequences with regard to the elongation can become prejudicial.

This means that if the flowrate is adjusted by means of a proportional pressure adjuster servo-valve, any change in the rate of advance, in the parameters of the formation, in the mode of utilisation of the cutting wheel, in the radii of curvature entailing a re-adjustment of the pressure, the flowrate will be passed on until this need for readjustment is manifested in terms of the elongations : there then apply transient "catching up" conditions which may be long-term given the destabilising integrator character of the rams (an integrator introduces a delay which increases the reaction time). Moreover, if the flowrate is adjusted by means of a flowrate adjustment device the formation parameters and the cutting wheel parameters then have virtually no influence on the necessary flowrates (as they influence only the thrust); what is more, the geometry of and the speed at which the trajectory is travelled can be taken into account for direct control over the flowrate adjustment devices without waiting for an error to appear in relation to the elongations. When an error in relation to the elongations does appear, it will be an error corresponding to imperfections of the flowrate adjustment system, and therefore minimal and quickly correctable: when the set point is changed, the real value converges with it without excessively length or excessively large amplitude oscillations.

Objects, characteristics and advantages of the invention will emerge from the following description given by way of non-limiting example only with reference to the appended drawings in which.

Figure 1:
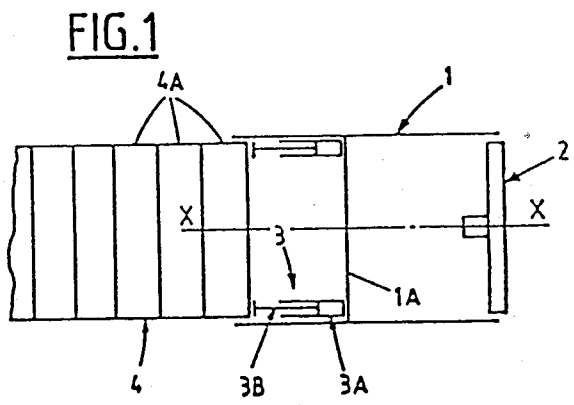
FIG. 1 is a diagram showing a shield-type tunnelling machine in longitudianl cross-section.

As shown in the FIG. 1 diagram, a shield-type tunnelling machine essentially comprises, in the known way, a generally cylindrical sleeve or envelope 1, known as the shield, the axis X—X of which defines the instantaneous axis of advance. At the front is a cutting wheel 2 fitted with cutting tools and designed to cut into the ground to enable the tunnelling machine to be moved forward ; it is driven by conventional means (not shown) situated in practice within the envelope 1. In the rear part are actuators 3 of the hydraulic ram type, the operation axes of which are parallel to the axis of advance. These rams comprise cylinders 3A attached to the shield 1 and pistons 3B which push against the lining 4 with which the tunnel is provided after the tunnelling machine has passed by, or against the shuttering used to construct the tunnel lining. The lining generally consists of reinforced concrete (cast iron, etc) rings 4A that are assembled and added as the tunnelling machine moves forward. The rams are operated by a hydraulic circuit (not shown in FIG. 1) accommodated in practice within the shield 1 and the structure of which will be explained hereinafter. A wall 1A provides for optional pressurisation of the cutting face.

Figure 2:
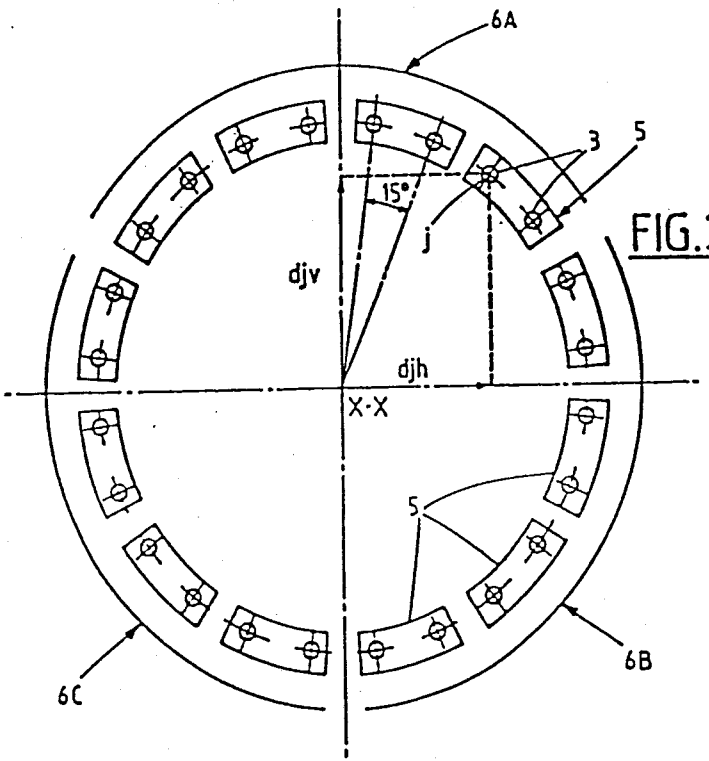
FIG. 2 is a diagrammatic view of the rear end of the tunnelling machine.

In the known way the thrust rams 3 are arranged in a ring, generally at constant angular intervals. In FIG. 2 there are 24 of these rams with an angular offset of 15°.

In this instance, the rams are grouped in pairs within thrust blocks 5. The blocks are in turn in three sectors or groups 6A, 6B and 6C with the same angular amplitude (60°) in this instance, respectively referred to as the "top", "bottom right" and "bottom left" sector or group. In an alternative arrangement (not shown) the rams are divided into a larger number of groups not necessarily all the same size.

Figure 3:
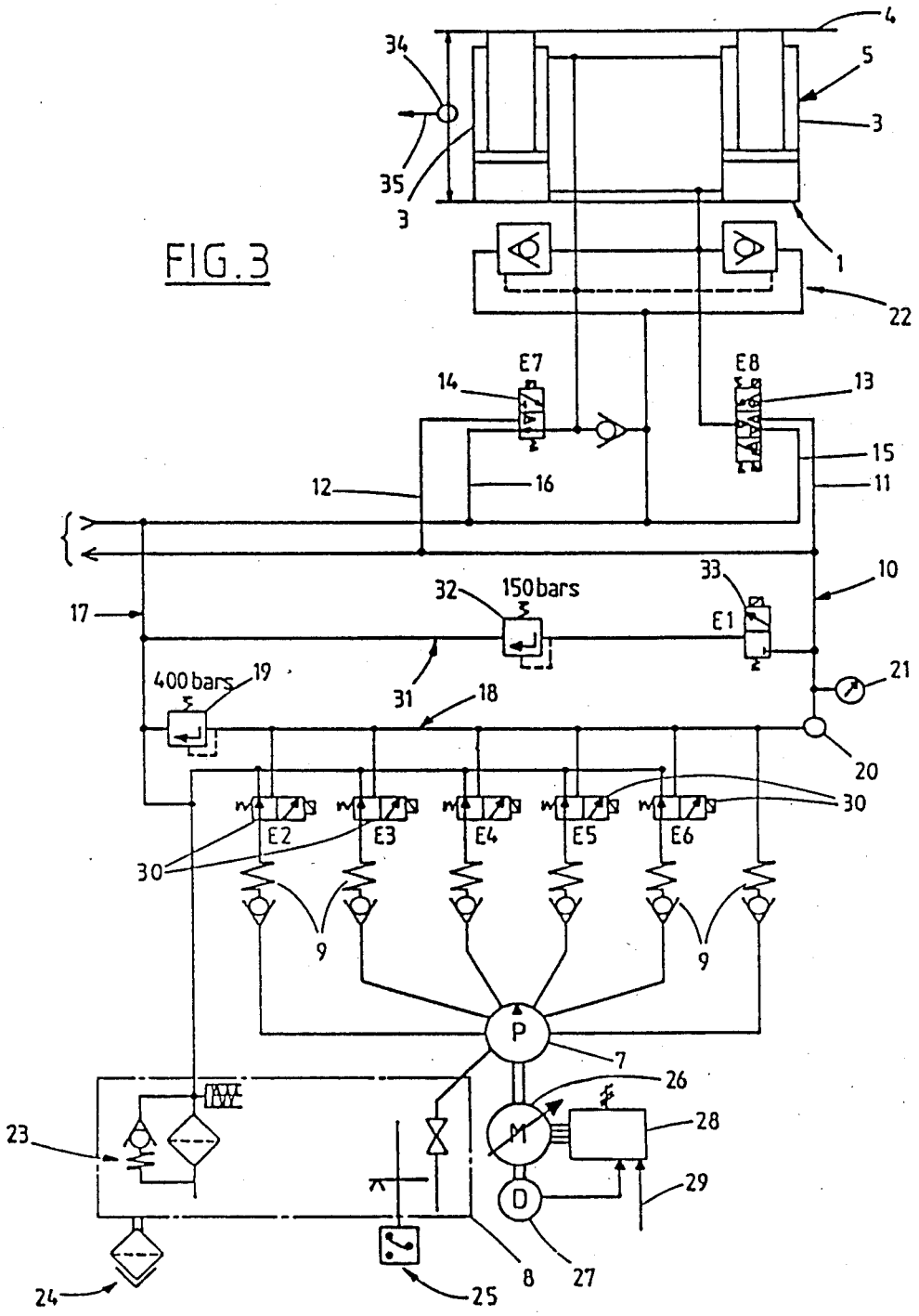
FIG. 3 is a diagram of part of the hydraulic circuit associated with each group of rams.

The set of thrust blocks 5 of each thrust sector or groups 6A, 6B or 6C is connected to a single hydraulic circuit the structure of which is schematically represented in FIG. 3.

The FIG. 3 circuit comprises, in the conventional way, at least one multiple-flowrate piston pump 7, with six outlets in this instance, taking up fluid (oil in practice) from a fluid storage tank 8 and feeding the fluid via non-return valves 9 to a ram feed line 10. This is divided into two sections 11 and 12 equipped with two selector solenoid valves 13 and 14 controlled synchronously to control the direction of displacement of the actuators 3, either in the direction of elongation or in the direction of contraction. Two sections 15 and 16 of a line 17 for returning fluid to the storage tank 8 also terminate at these soleniod valves. Between the fluid feed line 10 and the fluid return line 17 is a pipe 18 fitted with a pressure limiter 19 set to 400 bars for general protection of the circuit. A pressure sensor 20 and a general pressure gauge 21 are fitted to the line 10. The combination of pipe sections 11, 12, 15 and 16 is conventional and may comprise a variable pressure limiter (not shown) used for any number of the subgroups or blocks 5 of rams. Between the inlets of the two chambers of the double-acting rams 3 there is provided a circuit 22 with non return valves selectively openable to enable exhausting of the high flowrate from the large cross-section thrust chambers when the pistons are retracted (this excessively high flowrate could damage the solenoid valves). The lines 10 and 17 are also extended to the other pairs of rams in the same sector or group (towards the left in FIG. 3).

In an equally conventional way, the storage tank 8 is provided with a filter element 23 with a clogging bypass mounted at the end of the line 17, a device 24 for venting to atmospheric pressure and a level sensor 25.

In accordance with the invention, the fluid supply line 10 carries a variable flowrate that is adjusted continuously by a pumping set comprising the pump 7. In the FIG. 3 example, the pump 7 is fed by a variable speed motor 26 equipped with a tachogenerator 27 connected to a speed regulator device 28 of the electronic variable speed drive type. The variable speed drive 28 is supplied with power from the electrical mains supply and receives control signals over a line 29.

Certain at least (and possibly all) of the outlet lines from the pump 7 are equipped with solenoid valves 30 for "switching" the pistons of the pump 7. In this instance there are five solenoid valves, a sixth line (on the right in FIG. 3) allowing a minimal flowrate to be maintained at all times.

Also provided between the lines 10 and 17 is a supplementary line 31 equipped with a pressure limiter 32 set to 150 bars and a solenoid valve 33 adapted to enable this limiter to fulfil this function when excavation conditions(normal advance) do not apply.

At least one elongation sensor 34 is assOciated with each group of rams (in this instance with the pair of rams shown), providing measurement signals over a line 35.

To give specific examples:

the motor 26 is a LEROY SOMER type LSK 132 L08 DC motor rated at 21.5 kW;

the electronic variable speed drive 28 is a LEROY SOMER type VTU 3-75;

the tachogenerator 27 is a RADIO-ENERGIE type RE 0444;

the pressure sensor 20 is a SEREG 8000 SPR type;

the pump 7 has a capacity of $6\times3$ cm$^3$ per revolution; and the displacement sensor 34 may be a CAPTOSONIC sensor exploiting the WIEDMANN effect, a GENISCO PT stainless steel wire rotary potentiometer type sensor or a NOVOTECHNIC TLH LINOPOT type linear plastic track potentiometer, all these sensors being capable of providing an accuracy of 0.05% of full scale.

Figure 4:
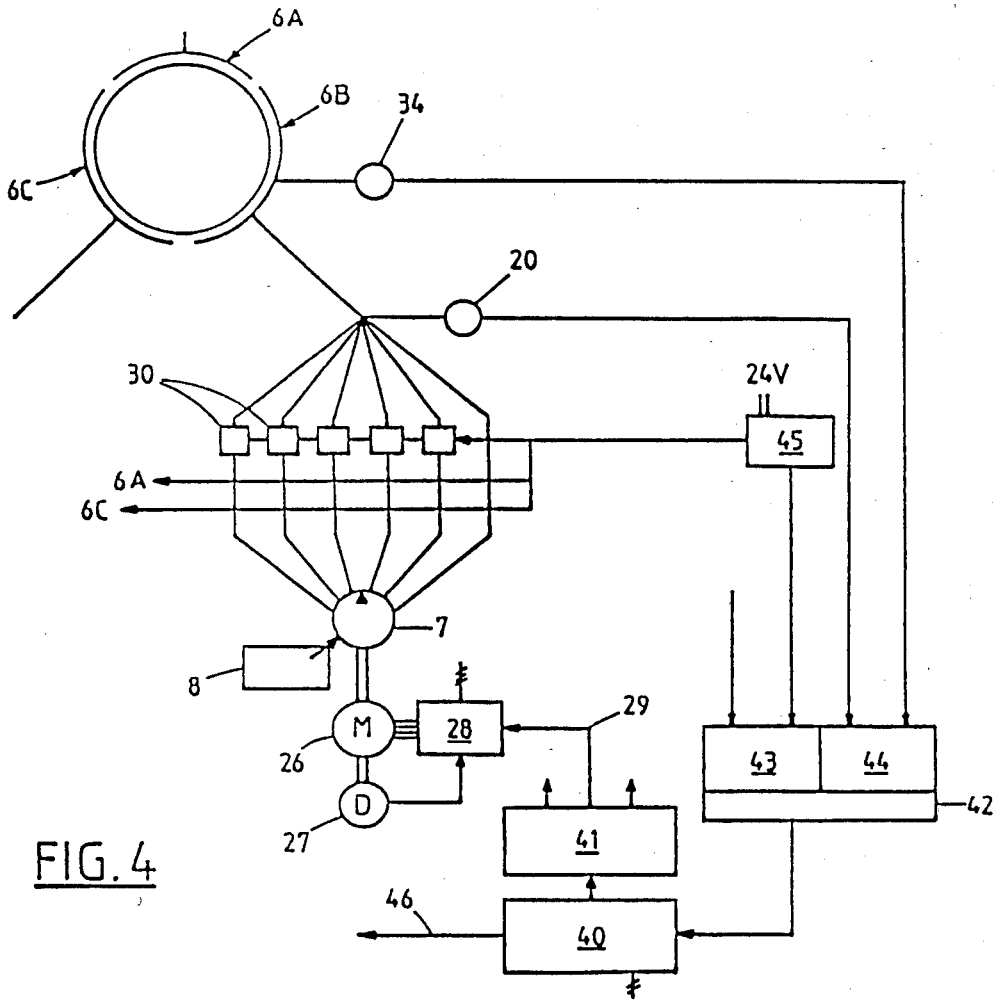
FIG. 4 is a diagram of part of the control circuit comprising as many hydraulic circuits of the FIG. 3 type as there are groups of rams.

FIG. 4 is a diagram showing the circuit of FIG. 3 with the addition of electrical connection lines for transmitting measurement signals and instructions.

Thus the circuit is completed by a computer 40 (Micro MAC 5000) equipped with a digital-to-analogue converter 41 (Micro MAC 4030) and a circuit card 42 (possibly integrated into the computer with the addition of QMX01 multiplexers) connected to a digital input unit 43 and an analogue-to-digital converter 44.

The unit 43 receives set point parameters R corresponding to the instantaneous radius of curvature of the tunnelling machine path that is required together with a signal from a speed control switch 44 (in this instance supplied at 24 V) also operative on the solenoid valves 30 for selecting the flowrate of the group 6B in question together with those of the groups of rams 6A and 6C, each equipped with a circuit of the type described with reference to FIG. 3.

The converter 44 receives measurement signals from the sensors 20 and 34 of each of the hydraulic circuits associated with the groups 6A, 6B and 6C.

The computer 40 generates digital signals (46) sent to display or alarm indicator devices (not shown), for example, and speed set point signals converted to analogue form by the converter 41 and sent to the various electronic speed drives 28 of the three groups 6A, 6B and 6C.

Although in the known systems each pump feeds all or part of the various groups of rams and an increase in the average rate of advance is obtained by successively starting up pumps whose various pistons are connected in parallel, the FIG. 3 circuit comprises a pumping set ( a pump or a combination of pumps) specific to a given thrust group so its flowrate can be adjusted INDEPENDENTLY by operating on the associated drive speed.

When the combination of the solenoid valves 13 and 14 is in a configuration to advance the associated ram (this is equally valid for a plurality of rams 3 controlled synchronously by corresponding groups of solenoid valves 13–14 operated simultaneously):

when stationary for placing rams on the supporting members 4, the solenoid valve 3 is energised to limit the pressure opposed to the cutting face pressure to 150 bars (in practice this pressure is determined according to the ratio of the usable surface areas of the rams and of the cutting face and of the cutting face pressure); to achieve rapid placement one or more solenoid valves 30 may be energised simultaneously; in an alternative embodiment (not shown) solenoid valves are provided to enable (only when the machine is stopped) the parallel connection of the various pumps of the various groups to increase the rate of displacement of the rams;

for excavation proper, the solenoid valve 33 is de-energised and the overall flowrate conditioning the rate of advance is adjusted by activating some or all of the solenoid valves 30 (conjointly with adjustment of the rotation speed of the cutting wheel 2) to avoid any exaggerated increase in its drive torque, in parallel on all the groups, simultaneously, the fine adjustment of the rotation speed of the motor 26 making it possible to obtain the required flowrate according to elongation ratios defined by computation for the various thrust groups, compensated by the measured elongation offset (between the actual value measured at 34 and the theoretical value) and by the pressure of the hydraulic circuit affecting the flowrate/pressure characteristic of the pump.

When the combination of the soleniod valves 13 and 14 enables retraction of the corresponding rams, the solenoid valve 33 is used to limit the maximum pressure and selective energisation of the solenoid valves 30 serves to adjust the rate of retraction of said rams, the other rams of the group remaining fixed in position.

Figure 5:
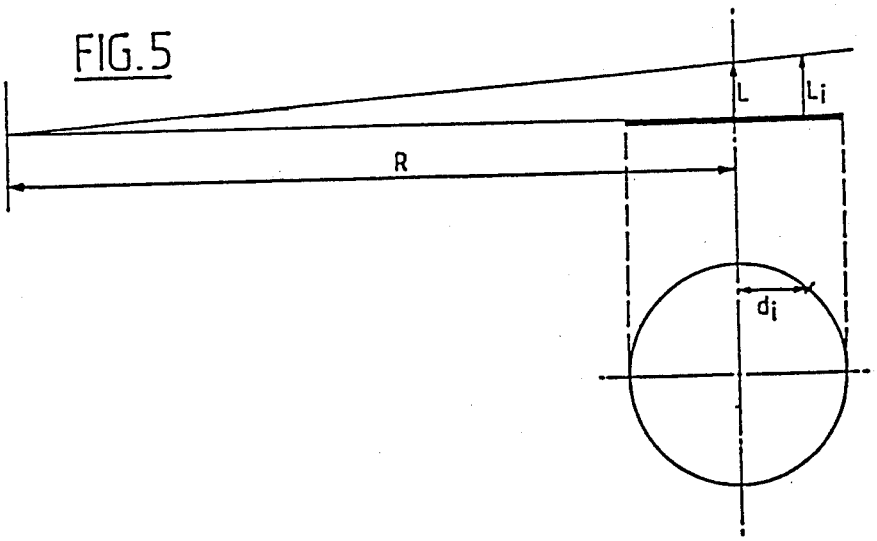
FIG. 5 is a diagram relating the elongation of a ram to the average elongation of the rams, to the instantaneous radius of curvature and to the position of that ram in a transverse plane.

The programming of the computer 40 is based on the following considerations:

Referring to the diagram in FIG. 5 where R designates the instantaneous radius of curvature of the (required) trajectory, L designates the average advance (along the axis) of the shield, Li designates the advance of a thrust ram i offset by a distance di parallel to the radius of curvature R and N designates the number of rams, the average elongation L is related to the elongations of the various rams by the equation:

$$L = \frac{1}{N} \sum_{i=1}^{N} Li$$

From this equation it can be deduced that the differential elongation li between a ram and the centre of the shield may be written:

$$li = Li - L = 1 \times \frac{di}{R}$$

Generalising and combining the rams in groups of n rams (three groups each of 8 rams in FIG. 2), it can be deduced that:

$$No,i = No\,(1 + \alpha vi/Rv + \alpha hi/Rh)$$

in which equation:

No is the rotation speed of the motors associated with the groups of rams for a linear displacement of the shield;

No,i is the set point rotation speed of the motor associated with the group i of rams for a required curvature with components Rv in a vertical and Rh in a horizontal plane; and αvi (or αhi) is a geometrical composition coefficient of the rams j of the group i in the vertical (or horizontal) plane, these coefficients being defined by the equations (see FIG. 2):

$$vi = \frac{1}{n} \sum_{j=1}^{n} djv \text{ and } hi = \frac{1}{n} \sum_{j=1}^{n} djh$$

djv and djh being the distances of the ram j from the horizontal and vertical planes, respectively.

Moreover, if Vo is the rate of advance of a group of rams for a speed No of the associated motor with one piston per pump and if mi is the number of pistons actually enabled on the pump associated with the group i of rams, then the rate of advance Vi of the rams associated with No,i is given by the equation:

$$Vi = No,i \times mi \times Vo/No$$

Also, the theoretical elongation at sensor i of the group i at the end of a succession of time intervals ΔT is written:

$$At,i = Vo\,\Sigma\,mi \left(1 + \frac{div}{Rv} + \frac{dih}{Rh}\right)\Delta T$$

This gives for group i with constant radius of curvature:

$$At,i = \frac{Vo}{No} \cdot No\left(1 + \frac{div}{Rv} + \frac{div}{Rh}\right)\Sigma\,mi \cdot \Delta T$$

which corresponds to incremental linear increases.

If Ai is the actual elongation on the bisector of the angular sector occupied by the rams of group i and sensed by an associated sensor 30, a correction of the motor speed is deduced from the differential elongation Ai−Ati :

$$Noi = Ai - At_i \cdot \frac{No}{Vo\,\Sigma\,mi \cdot \Delta T}$$

In the case where there is a plurality of sensors instead of a single sensor placed in the plane of symmetry of the thrust group, the geometrical composition of the measurements obtained by means of these sensors enable flowrate corrections to be applied to each group to be deduced.

Using a known PID (Proportional Integral Derivative) type control algorithm, the speed correction ΔNo,i can be obtained from this difference.

The value (No,i+ΔNo,i) is therefore the corrected rotation speed and the motor speed setpoint value Ni is calculated from the equation:

$$Ni = (No,i + \Delta No,i) \cdot f(p,i)$$

in which f(p,i) is possible compensation due to leakage from the pump with the pressure, that can be determined from the known flowrate/pressure characteristics of the latter.

Figure 6:
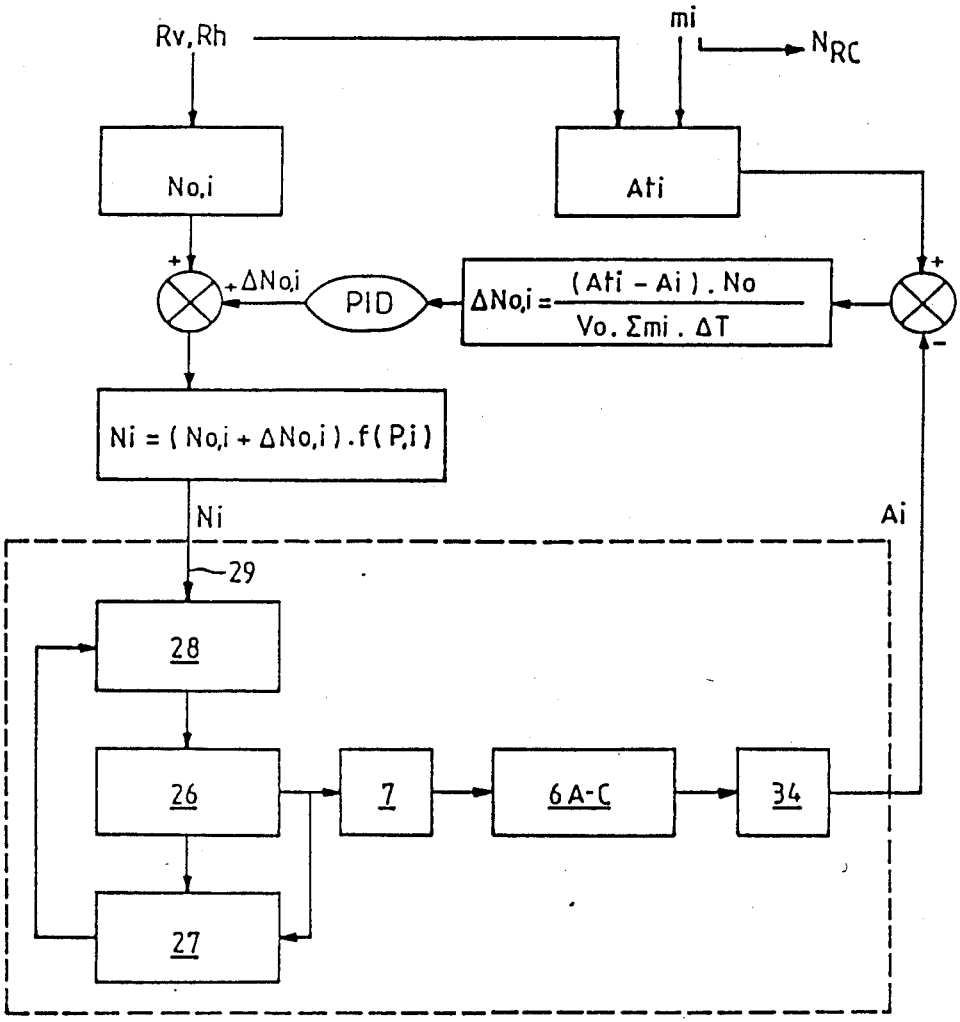
FIG. 6 is a flowchart showing how the circuit from FIG. 4 functions.

The flowchart shown in FIG. 6 is deduced from this, in which flowchart the hardware units receiving control signals or supplying measurement signals are enclosed in a dashed outline rectangle to distinguish them from the calculation operations. In this flowchart $N_{RC}$ designates the rotation speed of the cutting wheel.

If the number of rams is not the same in each group it is sufficient to compensate the rotation speed by taking No in the ratio of the numbers of rams in each group as the starting point for the calculation.

To avoid the need to adjust the flowrate for each group of rams, there may be a fixed group for which the elongation serves as a reference for the elongation of the other groups; this simplifies the overall hydraulic circuit.

If the pressure increases excessively, alarms are installed.

It will be understood that three groups of rams are sufficient for controlling the path of the tunnelling machine along any curvature in space.

In an alternative embodiment, the number of groups may be increased although the system then becomes a hyperstatic system. Four groups diameterally opposed with respect to horizontal and vertical axes mean that control in the horizontal and vertical planes can be decoupled. Also, if one elongation sensor is used per group failure of any sensor will not require the installation to be shut down (three sensors are sufficient to define the instantaneous orientation of the shield, conferring a high degree of security). A number of sensors greater than three may also be chosen with the same end in view, even if there are only three groups of rams.

Figure 7:
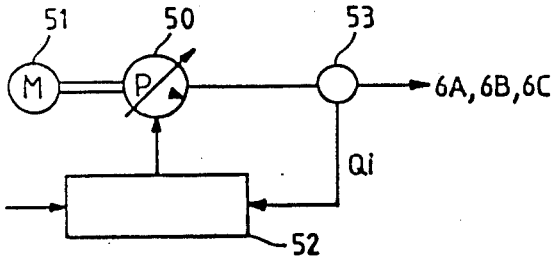
FIG. 7 is a detail view of the pumping set of a hydraulic circuit in a first embodiment.

FIG. 7 is a diagram showing another embodiment of the invention in which the variable flowrate required for the rams is obtained by means of a variable capacity pump 50 driven by a motor 51 at a speed that is fixed or considered to be fixed (an asynchronous motor, for example) and controlled by a regulator 52 which receives a flowrate measurement signal from a flowmeter 53 on the output side of the pump together with set point signals. The pump 50 may be a multiple-flowrate pump whereby the flowrate can be varied quickly and the adjustment dynamic range increased whilst reducing disparities between the various pumps, since the flowrate control plates of the pumps then remain virtually static and serve only for precise adjustment of the speed in order to compensate for the various leaks inherent to the functioning of said pumps.

Figure 8:
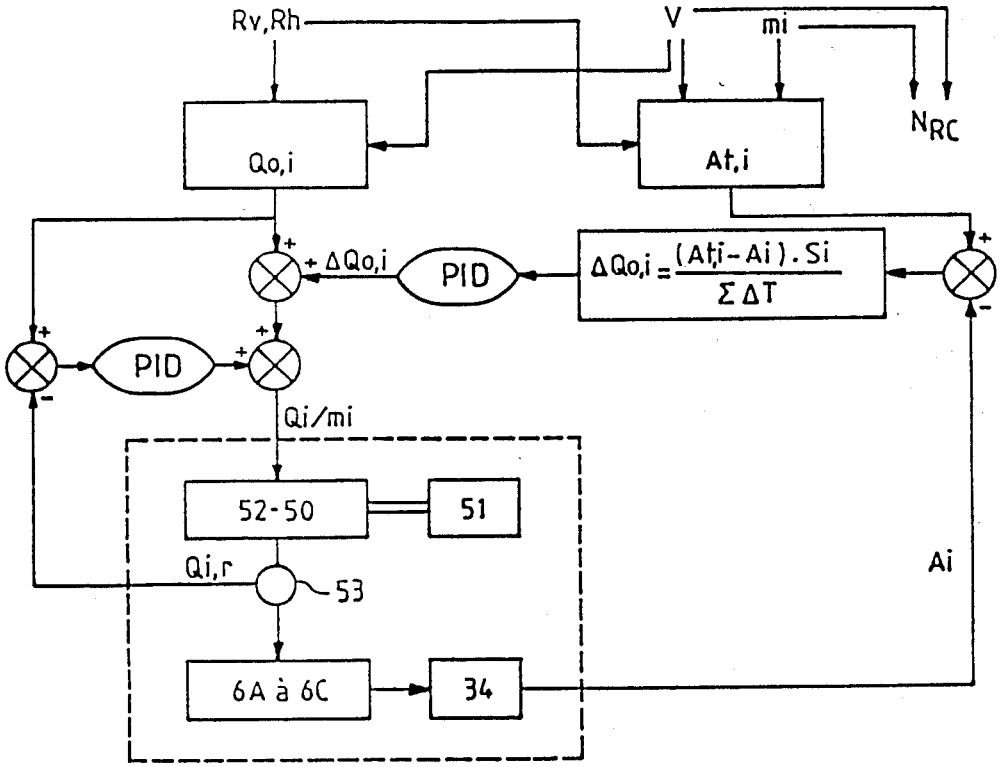
FIG. 8 is a flowchart showing how it functions.

FIG. 8 shows the associated flowchart which differs from that of FIG. 6 essentially in that the set point values are flowrates rather than rotation speeds. Also, comparison of the actual flowrate Qir with the theoretical flowrate Qoi results in an additional correction loop using a conventional PID algorithm. V represents the average rate of advance of the tunnelling machine, on the basis of which the rotation speed $N_{RC}$ of the cutting wheel in particular may be adjusted: Si is the total thrust surface area of the set of rams of group i.

Figure 9:
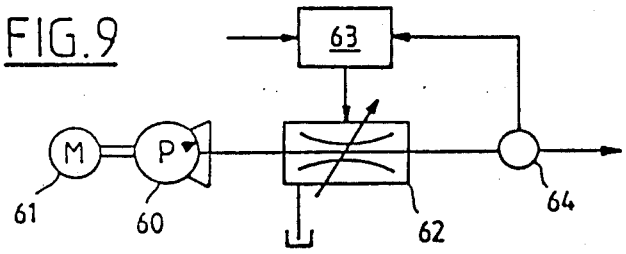
FIG. 9 is a detail view of the pumping set of a hydraulic circuit in a second embodiment.

In a further embodiment (see FIG. 9) use is made of a fixed capacity pump 60 driven by a fixed speed motor 61 with the flowrate adjusted on the output side of the pump by a flowrate adjustment proportional servo-valve 62 controlled by a regulator 63 receiving the flowrate measured by a flowmeter 64 together with set point values. This solution is very simple and has the disadvantage of being further limited in terms of the maximum permissible operating pressure. This may be acceptable in the case of small-diameter tunnelling machines. It is also possible to use a multiple-flowrate pump, although this still entails changing the set point of the servo-valve 62. On the other hand, the large number of pistons can avoid the bypassing of an excessive quantity of oil to the storage tank, which would be prejudicial to the efficiency of the servo-valve and could lead to overheating which would reduce its service life.

Figure 10:
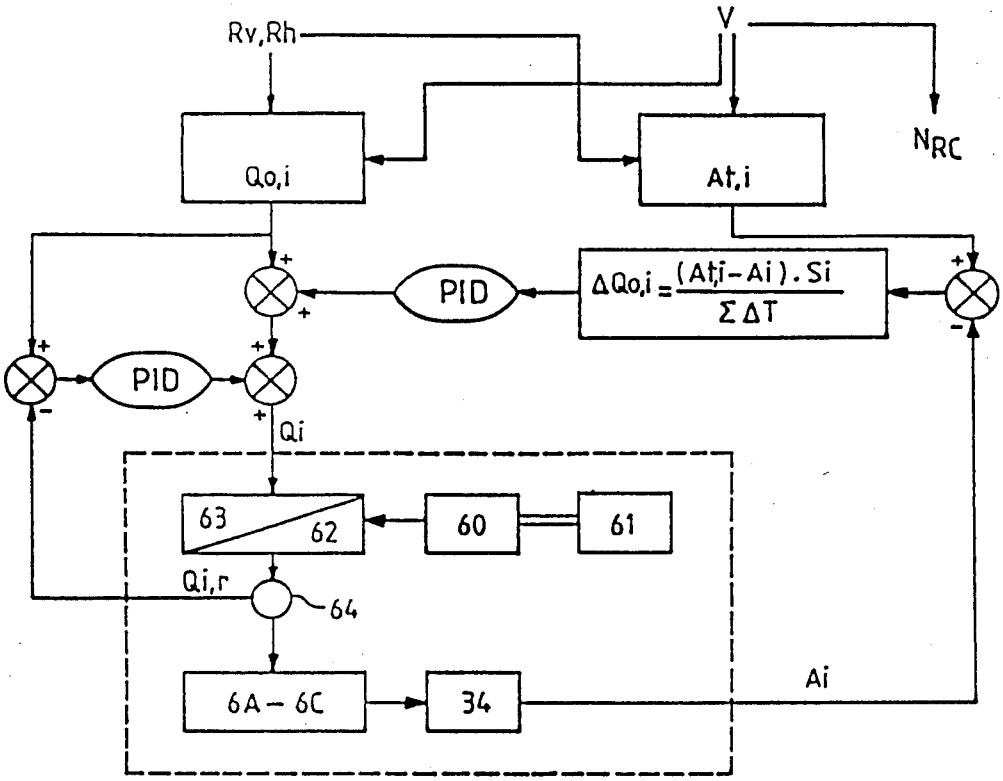
FIG. 10 is a flowchart showing how it functions.

FIG. 10 shows the associated flowchart as deduced from the previous flowchart on the basis of the above information.

In these two embodiments the pressure measurement serves only to monitor the pressure value and is limited to providing alarm indications where necessary.

The solution of FIGS. 3 through 6 with the variable speed motor is the most advantageous as it is possible to work at fixed rotation speeds for given curvatures, as the number of pistons enabled per pump does not change the ratio of the rotation speeds. Because of this, the changes in flowrate produce virtually no transient disturbances and are therefore in practice the most accurate possible prior to the feedback loop effect of measuring the elongation. Also, the direct loop is easy to implement in this case which makes it possible to effect looping with improved speed-stability optimisation.

It is obvious that the foregoing description has been given by way of non-limiting example only and that numerous variations may be put forward by the man skilled in the art without departing from the scope of the invention.

Thus the regulator devices 52 and 63 could be integrated into the associated computation unit.

The solenoid valves preferably comprise integral non-return valves.

Also, the FIG. 6 flowchart could have a flowrate monitor loop added as in FIGS. 8 and 10.

I claim:

1. A method of controlling the path of a shield-type tunnelling machine equipped with displacement control hydraulic rams divided into at least three groups comprising the steps of:

(a) setting an intended set point trajectory of advance for said machine along a desired path of curvature for advance of said machine;

(b) computing a theoretical instantaneous flow rate of fluid to be applied to each of said groups of rams in order to advance said machine along said intended set point trajectory;

(c) applying said theoretical instantaneous flow rate of fluid to each of said groups of rams; and (d) continuously and cyclically repeating steps (a)-(c) for each point along said desired path of curvature.

2. The method of claim 1, further comprising, for each cycle:

continuously, between steps (a) and (b), determining the theoretical elongations, of at least three sensors located at at least three reference points offset angularly at the periphery of said machine, which will occur when said rams are elongated to the extent required to advance said machine along said intended set point trajectory, the theoretical instantaneous flow rate of fluid being computed to equal that needed to achieve said theoretical elongations;

continuously measuring, between steps (c) and (d), the actual elongations of said at least three sensors;

determining the difference, if any, between the actual elongations and the theoretical elongations of said sensors;

correcting the instantaneous flow rate of fluid applied to each said group of rams to compensate for any said difference and achieve said theoretical elongations.

3. Method according to claim 2, wherein a reference point is associated with each group of rams.

4. A device for controlling the trajectory of a shield-type tunnelling machine having annularly arranged displacement control rams divided into three groups, and at least three pump means for pumping fluid from a storage tank to said rams, said device comprising:

three independent hydraulic circuits, each including one of said pump means, each of said group of rams corresponding to and being actuatable by a different one of said hydraulic circuits, at least two of said three independent hydraulic circuits each comprising a variable flow rate pump as said pump means, a computation means for continuously computing, for an intended set point trajectory along a desired path of curvature for advance of said machine, the theoretical instantaneous flow rates of fluid required to be applied to each of said groups of rams in order to advance said machine along said intended set point trajectory;

control means for continuously controlling the instantaneous flow rate of each said variable flow rate pumps to equal the computed theoretical instantaneous flow rate of fluid to be applied to each said corresponding group of rams.

5. A device according to claim 4, wherein all of said hydraulic circuits each comprise a variable flow rate pump.

6. A device according to claim 4, further comprising at least three elongation sensors at not less than three reference points angularly offset at the periphery of the machine;

said computation means including input means for receiving elongation information from said sensors, means for continuously computing the theoretical elongations of said sensors when said rams are elongated to the extent required to advance said machine along said set point trajectory, means for continuously determining the the difference between said theoretical and actual elongations and means for continuously correcting said control signal according to said difference.

7. Device according to claim 6, including at least one sensor corresponding to each group of rams.

8. Device according to claim 7, wherein each sensor is disposed on a bisector of the angular sector occupied by the corresponding group of rams.

9. Device according to claim 4 wherein each pump means comprises a fixed capacity pump driven by a variable speed motor controlled by a variable speed drive activated by the computation means.

10. Device according to claim 9, wherein the pump is a multiple-flowrate pump and selector solenoid valves are provided at at least some of its outlets.

11. Device according to claim 4 wherein each pump means comprises a variable capacity pump driven by a fixed speed motor and controlled according to the flow rate measured on its output side by a flowmeter.

12. Device according to claim 4 wherein each pump comprises a fixed flowrate pump which discharges through a flowrate adjustment proportional servo-valve according to the flowrate measured by a flowmeter on its output side.

13. Device according to claim 4, wherein said machine includes a cutting face, and each said hydraulic circuit includes a fluid supply line and a fluid discharge line, further comprising a pressure limiter line disposed between said fluid supply lines and said fluid discharge lines of said hydraulic circuits for counteracting pressure of the cutting face when excavation is halted.

* * * * *